US006315148B1

(12) United States Patent
Cornell et al.

(10) Patent No.: US 6,315,148 B1
(45) Date of Patent: Nov. 13, 2001

(54) METHOD FOR PACKAGING A LIQUID FILLED CONTAINER AND A CAPSULE THEREFORE

(75) Inventors: Stephen W. Cornell, Naperville, IL (US); Peter F. Murphy, Grosse Pointe, MI (US); David C. Brown, Chicago, IL (US)

(73) Assignee: The PopStraw Company, LLC, Roseville, MI (US)

( * ) Notice: Subject to any disclaimer, the term of this patent is extended or adjusted under 35 U.S.C. 154(b) by 0 days.

(21) Appl. No.: 09/503,803

(22) Filed: Feb. 14, 2000

Related U.S. Application Data

(62) Division of application No. 08/978,894, filed on Nov. 26, 1997, now Pat. No. 6,244,022.

(51) Int. Cl.[7] ..... B65D 51/16
(52) U.S. Cl. ..... 220/366.1; 206/217
(58) Field of Search ..... 220/366.1, 367.1, 220/23.83, 23.86, 375; 215/307, 355, DIG. 3; 206/217

(56) References Cited

U.S. PATENT DOCUMENTS

| | | | |
|---|---|---|---|
| 2,719,660 | | 10/1955 | Ellis . |
| 3,420,033 | | 1/1969 | Modderno . |
| 3,656,654 | | 4/1972 | Brinkley, III . |
| 4,051,977 | * | 10/1977 | Steinfeld ..... 221/96 |
| 4,109,817 | | 8/1978 | Payne et al. . |
| 4,228,913 | | 10/1980 | Mack et al. . |
| 4,305,521 | | 12/1981 | Komatsuta et al. . |
| 4,356,927 | | 11/1982 | Cooper et al. . |
| 4,357,324 | | 11/1982 | Montgomery et al. . |
| 4,510,734 | | 4/1985 | Banks et al. . |
| 4,690,294 | | 9/1987 | Jones . |
| 4,709,829 | | 12/1987 | Johnson et al. . |
| 4,728,001 | | 3/1988 | Serba . |
| 4,826,034 | | 5/1989 | Forbes . |
| 4,883,187 | | 11/1989 | Knitzer . |
| 4,892,187 | | 1/1990 | Stein . |
| 4,911,320 | | 3/1990 | Howes . |
| 4,923,083 | | 5/1990 | Forbes . |

(List continued on next page.)

*Primary Examiner*—Stephen Castellano
(74) *Attorney, Agent, or Firm*—Harness, Dickey & Pierce, P.L.C.

(57) ABSTRACT

A method for packaging a liquid filled container including the steps of providing a container, placing a capsule defining the cavity in the container, filling the container with a liquid, and allowing a gaseous exchange between the liquid and the cavity to provide a benefit to one of the capsule and the liquid. The invention also includes a method for providing retrievable payload in a liquid filled container that includes the steps of providing a capsule in a liquid filled container wherein the capsule has a cavity and is associated with the payload. The method further including the step of pressurizing the cavity.

The present invention also includes a capsule having a body defining a cavity and an opening communicating with the cavity, a payload disposed in the cavity, sealing means for sealing the cavity which contains gas at a first pressure greater than atmospheric pressure when the cavity is sealed, and vent means for selectively venting the pressurized gas from the cavity. Other embodiments of the capsule include a cap engageable with the body at the opening and movable between a sealed position wherein the cap engages the body to seal the cavity and an open position providing access to the cavity. Connecting means and presentation means may also be included with the capsule for coupling the cap to the body when the cap is removed from the opening and for moving the payload toward the opening when the cap is in the open position, respectively.

10 Claims, 13 Drawing Sheets

U.S. PATENT DOCUMENTS

| | | | | |
|---|---|---|---|---|
| 4,923,084 | | 5/1990 | Forbes . | |
| 4,938,007 | | 7/1990 | Sperry . | |
| 5,027,583 | | 7/1991 | Chelak . | |
| 5,046,631 | | 9/1991 | Goodman . | |
| 5,056,659 | | 10/1991 | Howes et al. . | |
| 5,056,681 | | 10/1991 | Howes . | |
| 5,071,019 | | 12/1991 | Sizemore . | |
| 5,099,232 | | 3/1992 | Howes . | |
| 5,172,827 | | 12/1992 | Chang et al. . | |
| 5,283,567 | | 2/1994 | Howes . | |
| 5,297,561 | * | 3/1994 | Hulon | 128/764 |
| 5,325,977 | * | 7/1994 | Haynes et al. | 215/307 |
| 5,439,103 | | 8/1995 | Howes . | |
| 5,466,473 | | 11/1995 | Forage et al. . | |
| 5,482,158 | | 1/1996 | Piester . | |
| 5,714,186 | | 2/1998 | Nash et al. . | |
| 5,720,406 | * | 2/1998 | Fassbind et al. | 220/23.4 |
| 5,722,553 | * | 3/1998 | Hovatter | 220/23.8 |
| 5,899,351 | * | 5/1999 | Murphy et al. | 220/23.86 |

* cited by examiner

METHOD FOR PACKAGING A LIQUID FILLED CONTAINER AND A CAPSULE THEREFORE

This is a division of U.S. patent application Ser. No. 08/978,894, filed Nov. 26, 1997, now U.S. Pat. No. 6,244,022.

BACKGROUND OF THE INVENTION

1. Technical Field

The present invention relates to containers and, more particularly, to a method for packaging a liquid filled container with a capsule configured to deliver a payload therefrom.

2. Discussion

In recent years, various devices have been developed for delivering a payload such as a prize from a container when the container is opened. For example, reference may be made to U.S. Pat. Nos. 4,911,320, 5,056,659, 5,099,232, and 5,283,567 issued to Howes as well as to U.S. Pat. No. 5,482,158 to Plester for a general description of such devices. The disclosures of the above-referenced patents are incorporated herein by reference. Also incorporated by reference is U.S. patent application Ser. No. 08/711,116, entitled "Device For Containing And Delivering A Payload From A Container", filed Sep. 9, 1996. In the devices described in the above-referenced patents and applications, the payload is generally contained within a sealed capsule, tube, or vial submerged in the liquid filled container. The sealed capsule is delivered through an orifice in the container when the container is opened. In general, the buoyancy of the sealed capsule is used to urge the capsule upward through the orifice.

The above-described payload delivery systems are often used within pressurized containers such as carbonated beverage cans. Conventional payload delivery capsules maintain the capsule cavity completely sealed from the beverage and gases therein. For example, the Plester patent teaches trapping air within the capsule to provide the necessary buoyancy. Applicants have found that forming the payload capsule of certain liquid tight materials that are permeable to the pressurized carbon dioxide gas provide benefits not previously recognized in the art.

Conventional devices fail to recognize or take advantage of the potential benefits of allowing a gaseous exchange between the capsule cavity and the liquid as well as the heightened pressure within the cavity after the container is opened. Conventional devices also fail to recognize the ability to manage the rate of gaseous exchange to maximize these benefits through the selection of materials for the capsule. The benefits alluded to above include payload presentation opportunities available through use of the pressurized gas within the capsule cavity, devices for managing the dissipation of the pressure when the capsule is opened to make the opening event more enjoyable, and transfer of gaseous material from the capsule to the liquid. Attendant to these benefits is the need to manage the pressure in the cavity in order to minimize the possibility of the capsule cap "missiling" during opening.

SUMMARY OF THE INVENTION

Accordingly, a need exists for a method for packaging a liquid filled container in a manner that takes advantage of the benefits realizable due to a gaseous exchange between the liquid and the capsule cavity. A need also exists for a method for presenting a payload upon the opening of a liquid filled and pressurized container that again capitalizes on the gaseous exchange between the liquid and the capsule cavity. Finally, in order to effectively realize the above advantages, a need also exists for a capsule that allows the above gaseous exchange and includes structure for presenting the capsule payload in an attractive manner while effectively venting or otherwise dissipating the pressure within the capsule cavity to prevent missiling of the capsule cap.

The present invention is directed to a method for packaging a liquid filled container with a gas permeable payload delivery capsule as well as a method for presenting the payload upon the opening of the container. More particularly, the method of the present invention includes the steps of providing a container, placing a capsule in the container, filling the container with a liquid, and allowing a gaseous exchange between the liquid and the cavity to provide a benefit to one of the capsule and the liquid. The payload presentation method generally includes method steps similar to those recited above with the additional steps of removing the pressurized capsule from the container, venting the cavity, and removing the payload.

The present invention is also directed to a capsule that manages the dissipation of pressure in the capsule. More particularly, the present invention includes a payload delivery capsule that includes a body defining a cavity and an opening communicating with the cavity, a payload disposed in the cavity, and, in alternate embodiments of the invention, either: sealing means for sealing the cavity such that the cavity contains a gas at a pressure greater than atmospheric pressure and vent means for selectively venting the pressurized gas from the cavity; a cap engageable with the body and movable between a sealed position and an open position and connecting means for coupling the cap to the body when the cap is removed from the opening; or a cap engageable with the body at the opening and movable between a sealed position and an open position and presentation means for moving the payload toward the opening when the cap is in the open position.

BRIEF DESCRIPTION OF THE DRAWINGS

The objects and features of this invention will become further apparent from a reading of the following detailed description taken in conjunction with the drawings, in which.

DETAILED DESCRIPTION OF THE PREFERRED EMBODIMENTS

Figure 1:
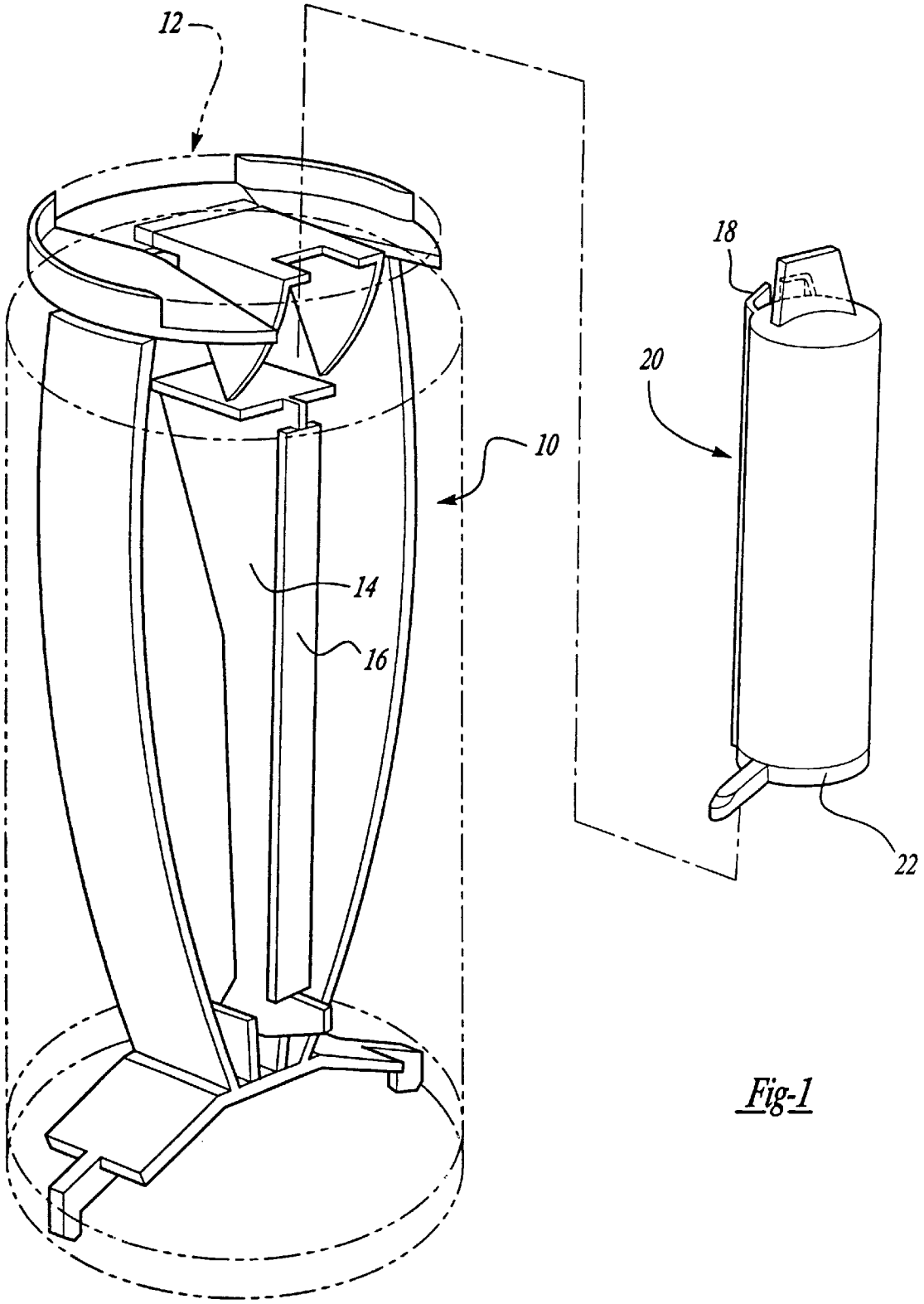
FIG. 1 is a partially exploded perspective view of a payload delivery device including a capsule according to the present invention.

Referring to FIG. 1, a payload delivery device 10 is shown disposed within a cylindrical container 12. The general structure and operation of payload delivery device 10 is described in co-pending U.S. application Ser. No. 08/711,116, entitled "Device For Containing And Delivering A Payload From A Container", filed Sep. 9, 1996, the disclosure of which is hereby incorporated by reference. Payload delivery device 10 includes a stand 14 with a coupling member 16 configured to slidably engage a cooperating retaining member 18 on a capsule 20. The stand, coupling member, and retaining member cooperate to align capsule 20 with orifice 32 (FIG. 2*b*) such that capsule 20 is presented through orifice 32 as hereinafter described. Numerous modifications may be made to the stand and capsule to provide these alignment and deployment features without departing from the scope of the invention as defined by the appended claims.

Figure 2A:
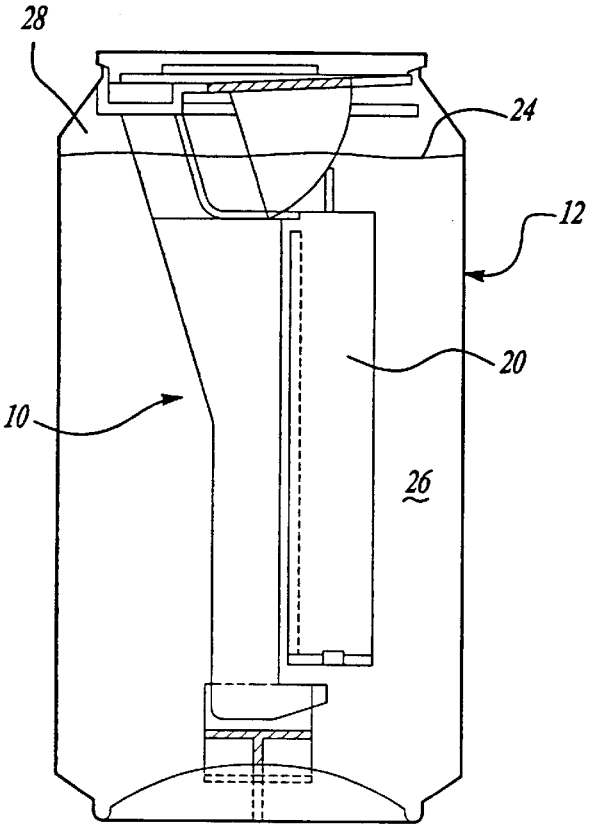
FIG. 2*a* is a side elevational view of the container shown in shadow in FIG. 1 and the payload delivery device having the capsule is in a storage position.
Figure 2B:
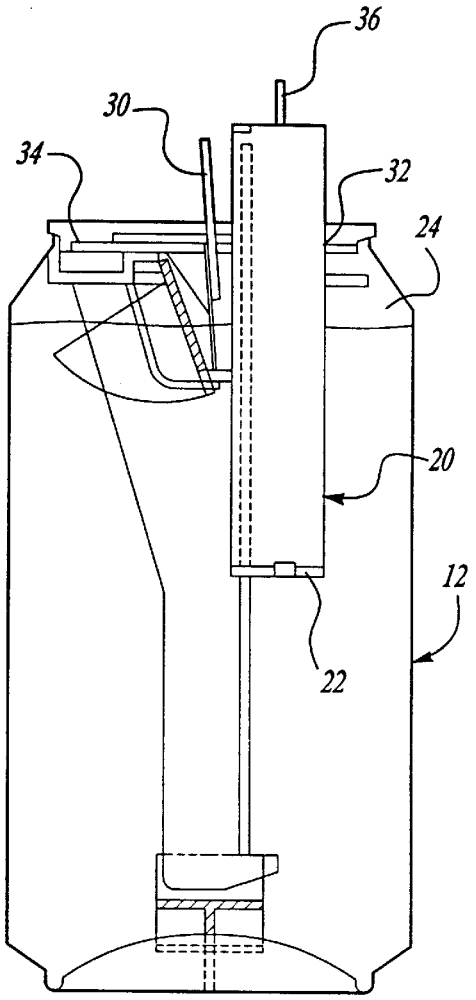
FIG. 2*b* is a side elevational view similar to that of FIG. 2*a* with the capsule presented through the container orifice.

Payload delivery device 10 is configured to delivery capsule 20 from a stored position illustrated in FIG. 2*a* to a payload presentation position illustrated in FIG. 2*b* from which the consumer can grasp capsule 20 such as by tab 36 and remove it from the container. The consumer can then gain access to the payload contained within capsule 20 through displacement of cap 22 (FIG. 1). As indicated above, the present invention is directed to a method for packaging container 12 and various embodiments of capsule 20 that manage, utilize, dissipate, or otherwise compensate for the pressure buildup within the capsule cavity.

With continued reference to FIGS. 1, 2*a* and 2*b*, packaging of a liquid filled container with the payload delivery device and gas permeable capsule is initiated by providing an appropriate container such as the can 12 illustrated in the above-referenced figures. While the container 12 is shown in the illustrated embodiments as a twelve-ounce beverage can, it is contemplated that the invention may be used with any conventional liquid container including flat-top containers such as the illustrated can, cone top containers, such as metal cone top cans, carbonated beverage bottles made of plastic or glass, as well as other plastic or cardboard cartons with flat or gabled tops. While certain modifications to the capsule delivery device as well as the configuration of the capsule itself may be necessary to most efficiently use the present invention in some containers, many modifications may be made to the present invention without departing from the proper scope thereof as defined by the appended claims.

Capsule 20 is placed within container 12 either with or without the delivery device 10 illustrated in the drawings. The primary function of delivery device 10 is to orient capsule 20 beneath the deployment orifice and retain the capsule in the stored position until the orifice is opened. Those skilled in the art will appreciate that a variety of alignment and deployment devices may be used with the present invention without departing from the scope of the invention as defined by the appended claims.

Before container 12 is ready for shipment to a consumer, the container is filled with the appropriate fluid. The filling of the container may occur either before or after the placement of capsule 20 within container 12. Numerous techniques and devices are generally available in the art for filling containers with a fluid. Those skilled in the art are capable of selecting the most appropriate filling device or technique after considering the container configuration, type of fluid used, and other commonly considered parameters. A fluid fill line is illustrated in FIGS. 2*a* and 2*b* and indicated by reference numeral 24.

In the preferred embodiment of the present invention, capsule 20 is formed of polypropylene in order to minimize manufacturing costs and optimize the performance characteristics of the capsule. More particularly, it has been found that the permeability of polypropylene allows adequate gaseous exchange between the liquid 26 and the capsule cavity (illustrated and described in detail hereinafter) to provide the anticipated benefits while preventing permeation or other leaking of the liquid 26 into the capsule cavity. More particularly, when a carbonated beverage is provided within can 12 and conventionally pressurized with four volumes of carbonation to an appropriate pressure of about 60 $lbs/in^2$ gauge, a polypropylene capsule allows sufficient carbon dioxide gas to permeate through the capsule side walls and into the capsule cavity. As a result, the cavity pressure equilibriates with the pressure in the head space 28 of the container. While applicants have found that a polypropylene capsule is particularly effective for payload presentation from carbonated and pressurized beverage cans, other materials and coatings may be used during the manufacture of capsule 20. Such materials include, but are not limited to, aluminum foil, glass, PVdC coating, AN coating, PVOH coating, and SiOx coating on a suitable polymeric substrate.

In the preferred embodiments of the present invention, it is also desirable to manufacture capsule 20 of a photo-degradable material in order to minimize the waste disposal impact of the capsule. Those skilled in the art will appreciate that a variety of photo-degradable materials known in the art may be used without departing from the scope of the invention as defined in the appended claims.

Upon opening of the container 12 such as through actuation of tab 30 to form an orifice 32 in the top 34 of can 12, the pressurized gas stored in head space 28 is expelled through orifice 32 and the capsule 20 rises due to its buoyancy. In its presentation position illustrated in FIG. 2*b*, capsule 20 extends through orifice 32. When presented in this manner, axially extending tab 36 of capsule 20 may be grasped by a consumer and the capsule removed from container 12.

Before addressing various configurations of capsule 20 that use the pressurized gas within the capsule cavity to provide the contemplated payload presentation benefits, it should be noted that the gaseous exchange between the capsule 20 and liquid 26 may occur either from the liquid to the capsule as in the carbonated liquid illustration described above, or from the capsule to the liquid. For example, the capsule cavity may be provided with a gas that permeates through the capsule walls and into the liquid to advantageously produce a chemical reaction with the contents, prevent a chemical reaction with contents, or is inert to the contents. Applicable gases include carbon dioxide ($CO_2$) for carbonating a beverage such as a soft drink, nitrogen ($N_2$) for preserving fluids such as juices, and air. However, the gases may also include other noble gases or reactive gaseous species to realize the above recited, and other, benefits without departing from the scope of the invention as defined by the appended claims.

Numerous embodiments of the payload delivery capsule will now be described with reference to the remaining figures. The embodiment of the capsule illustrated in FIGS. 3–4 will be described in detail with reference to capsule 100. It should be appreciated that capsule 100 is substantially the same as the capsule 20 illustrated in FIGS. 1, 2*a*, and 2*b*. Payload delivery capsule 100 includes a generally cylindrical payload tube 102 having a closed end 104, an open end 106, and a cylindrical side wall 108 defining payload cavity 120. However, those skilled in the art will appreciate that a variety of tube configurations may be used for tube 102 without departing from the scope of the invention as defined by the appended claims.

In the illustrated embodiment, a payload 119 is disposed within cavity 120 for presentation to a consumer upon opening of capsule 100. While the remaining figures illustrate the capsule as containing a payload 119, those skilled in the art will appreciate that the capsule 100 may be provided within container 12 for the sole purpose of providing gaseous exchange benefits to the liquid as described above, for payload presentation alone, or for a combination of these benefits.

A retraction tab 110 is integral with closed end 104 to allow a customer to grip and remove capsule 100 from the container such as through orifice 32 (FIG. 2*b*). While the configuration of retraction tab 110 is illustrated in the figures as having a generally trapezoidal shape, those skilled in the art will appreciate that a variety of configurations may be used without departing from the scope of the invention as defined by the appended claims.

Capsule 100 is configured to include a vent arrangement 116 and tether mechanism 117 for dissipating the pressure within cavity 120 and interconnecting closure cap 112 with tube 102, respectively. The dissipation of pressure within cavity 120 via the vent arrangement is important not only for the controlled opening of cap 112 but also for the various assemblies hereinafter described that utilize the pressure buildup in the capsule cavity.

Figure 3:
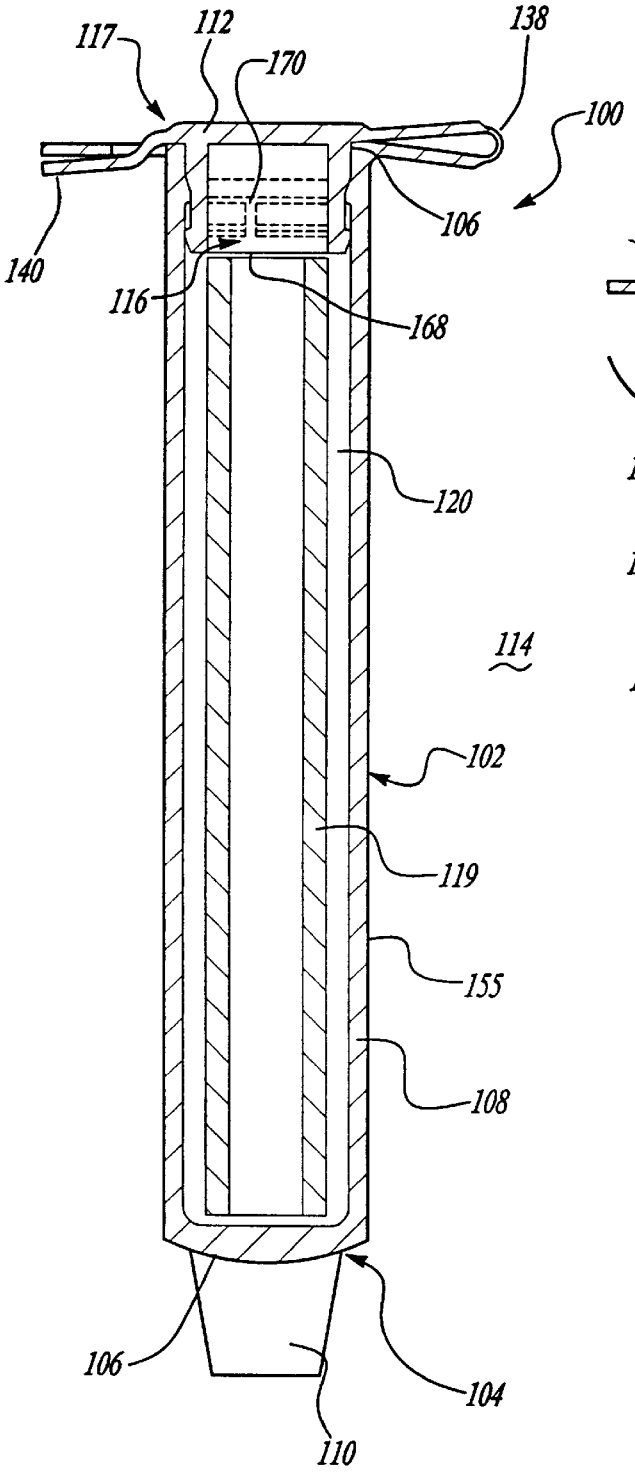
FIG. 3 is an axial cross-sectional view of a delivery capsule according to one embodiment of the present invention.
Figure 5:
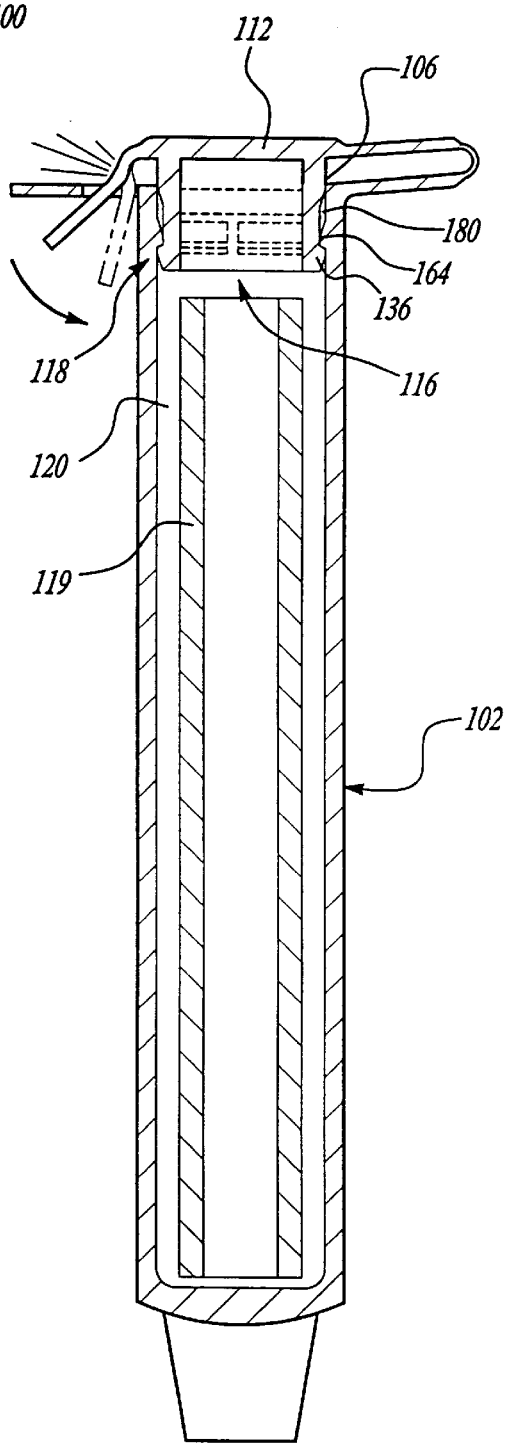
FIG. 5 is an axial cross-sectional view of the capsule illustrated in FIGS. 3 and 4 with the cap in a partially open and venting condition.
Figure 6:
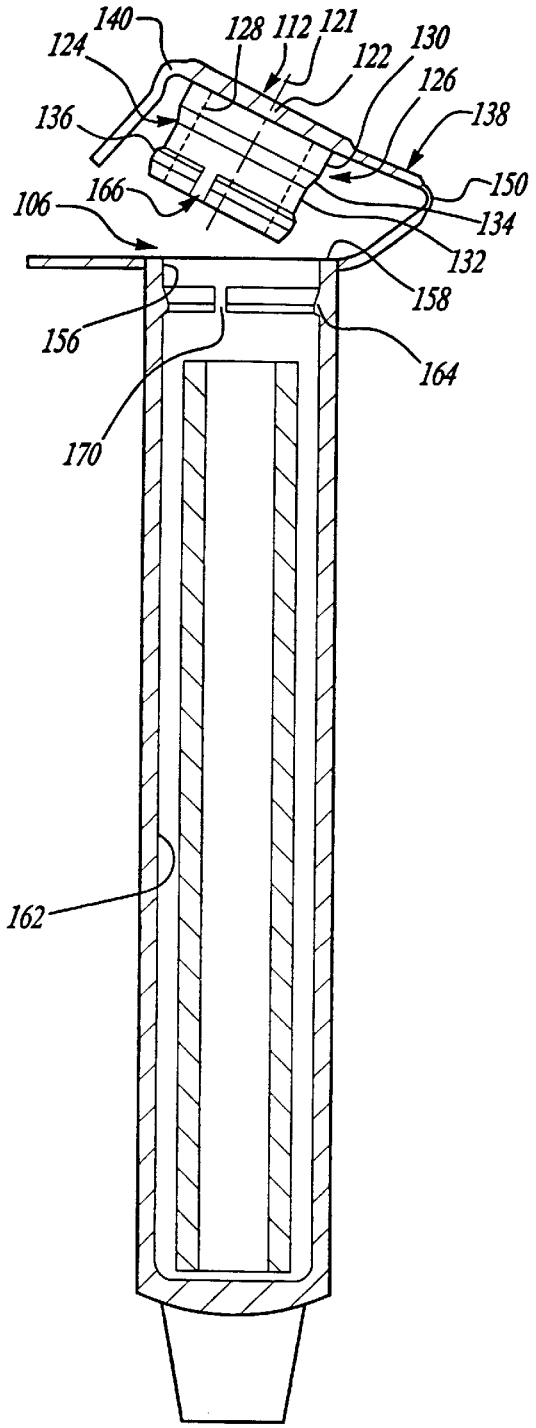
FIG. 6 is an axial cross-sectional view of the capsule illustrated in FIGS. 3–5 with the cap in its fully open position.

Cap 112 is positionable relative to opening 106 in a sealed position illustrated in FIG. 3, a venting position illustrated in FIG. 5, and a fully removed position illustrated in FIG. 6. Those skilled in the art will appreciate from the following description that other than permeation through tube 102, payload cavity 120 is substantially isolated from the environment 114 surrounding capsule 100 when cap 112 is in the sealed position. In general, the cap is maintained in the sealed position until capsule 100 is removed from the container and selectively opened by the consumer.

Upon initiation of opening, cap 112 is pried from, or otherwise axially displaced relative to, opening 106 and into the venting position illustrated in FIG. 5. At this point, the payload cavity 120 pneumatically communicates with the environment 114 outside of capsule 100 via vent arrangement 116. After cavity 120 is vented, the cap 112 may be completely removed from opening 106 as illustrated in FIG. 6.

A cap retention apparatus 118 encourages the sequential displacement of cap 112 from the sealed position illustrated in FIG. 3, to the vented position illustrated in FIG. 5, and, finally, to the fully removed position illustrated in FIG. 6. By the step-wise displacement of the cap relative to tube 102, the pressure difference between the environment 114 surrounding payload cavity 120 is dissipated in a controlled manner. This feature minimizes the probability of cap missiling and, as will be described with reference to the further embodiments of the invention, may be used for a variety of other advantages. The configuration of vent arrangement 116, tether mechanism 117, and cap retention apparatus 118 will now be described in detail with reference to cap 112 and the configuration of tube 102 proximate to opening 106. It should be noted that, for completeness, tube 102 and payload 119 are shown in cross-section in FIGS. 3, 5, and 6 while cap 112 and tether mechanism 117, including a connecting hinge 138, a tether 140, and a tether coupling tab 152, are illustrated in cross-section in FIGS. 3 and 5 and in a side elevational view in FIG. 6.

With reference to FIG. 6, cap 112 is a generally cylindrical tubular member formed about an axis 121 and includes an annular top 122 integral with an axially projecting sleeve 124. Sleeve 124 generally defines an outer surface 126 and an inner cylindrical surface 128. Outer surface 126 includes a radial seal face 130 extending axially from annular top 122 and a recessed radial surface 132 interconnected with radial seal surface 130 via taper 134. A cap stop 136 projects radially from recessed radial surface 132 at an end thereof remote from taper 134.

Cap stop 136 cooperates with a tube stop 164 to form cap retention apparatus 118 (FIG. 5). More particularly, with reference to tube 102 proximate to opening 106, a tubular seal face 156 (FIG. 6) extends along tube axis 160 from an end surface 158 that defines opening 106. An inwardly projecting tube stop 164 separates seal surface 156 from an inner surface 162 of cavity 120. As illustrated in FIG. 5, tube stop 164 cooperates with cap stop 136 to limit the initial axial displacement of cap 112 relative to tube 102. As a result, cap retention apparatus 118, as well as the below described tether mechanism 117, prevent missiling of cap 112 upon its removal. Additionally, stops 164 and 136 cooperate to position cap 112 relative to tube 102 such that the hereinafter described vent arrangement 116 is allowed to dissipate the internal pressure within cavity 120.

Turning to tether mechanism 117, cap 112 is coupled to tube 102 proximate to open end 106 via a connecting hinge 138 formed integral with cap 112 and tube 102. Hinge 138 indudes a first leg 146 integral with cap 112 and a second leg 148 integral with tube 102. First and second legs 146 and 148 are interconnected via a hinge section 150 of reduced thickness.

Figure 4:
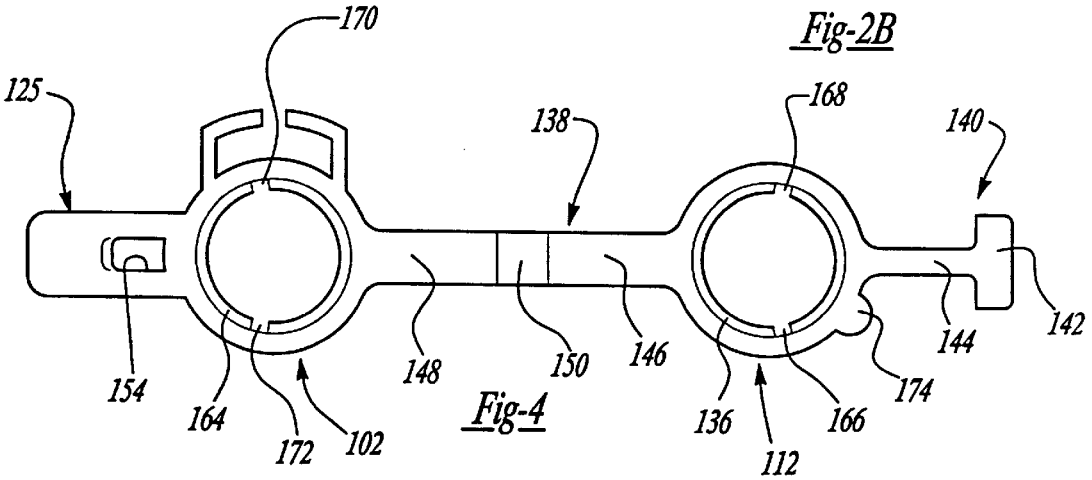
FIG. 4 is a top plan view of the capsule illustrated in FIG. 3 after opening.

Extending from cap 112 in a position opposing connecting hinge 138 is a tether 140. As best illustrated in FIG. 4, tether 140 includes a head 142 connected to cap 112 via neck portion 144. A tether coupling tab 152 extends from tube 102 opposite second leg 148 and includes an opening 154 formed therein. Head 142 of tether 140 is insertable within and through opening 154 by bending or otherwise elastically deforming head 142. When tether 140 is sufficiently disposed through opening 154, head 142 is allowed to expand to its original configuration whereupon neck 144 is disposed within opening 154 as illustrated in FIG. 3. Head 142 may be selectively removed from opening 154 to release tether 140 preferably after dissipation of the pressure within capsule cavity 120. By requiring the affirmative disengagement of tether 140, tether mechanism 117 reduces the possibility that cap 112 will missile due to the pressure within the capsule cavity. Similarly, the permanent connection of cap 112 to tube 102 via hinge 138 prevents missiling of the cap.

Tether mechanism 117 provides the further advantage of restricting removal of capsule 100 from the orifice 32 in container 12. More particularly, while the capsule 100 is sized such that the outer surface 155 (FIG. 3) of tube 102 is smaller than the opening defined by orifice 32, the hinge 138 and tether 140 (FIG. 3) extend radially outward from surface 155 to abut the container surfaces surrounding orifice 32 to prevent inadvertent removal of capsule 100. The hinge 138 and tether 140 are resilient members designed to yield under the retraction force exerted by a consumer. Accordingly, the tether 140 and hinge 138 allow the capsule 100 to be removed from container 12 by the consumer while preventing inadvertent removal thereof.

Vent arrangement 116 will now be described in detail. As best illustrated in FIG. 4, cap stop 136 defines vent recesses 166 and 168. Similarly, tube stop 164 defines cooperating recesses 170 and 172. When cap 112 is in its sealed position relative to tube 102 as illustrated in FIG. 3, fluid or air flow from payload cavity 120 to the environment 114 outside capsule 100 via the cooperating recesses, is prohibited by the sealing engagement between seal surface 156 of tube 102 and seal face 130 of cap 112. After the consumer has removed capsule 100 from container 12, the consumer can displace cap 112 by engaging a pry tab 174 (FIG. 4) and urging cap 112 into the venting position illustrated in FIG. 5.

In the venting position, taper 134 and recessed surface 132 of cap 112 cooperate with seal surface 156 of tube 102 to define an intermediate chamber 180 (FIG. 5) that communicates with the environment 114 surrounding capsule 100 and with payload cavity 120 via cooperating recesses 166, 168, 170, and 172. As a result, any pressure difference between payload cavity 120 and the environment 114 surrounding capsule 100 is equalized before cap 112 is moved to the removed position illustrated in FIG. 6.

In the unlikely event that the pressure difference between payload cavity 120 and environment 114 is sufficient to overcome the locking engagement of stops 136 and 164, tether mechanism 117 acts to restrict missiling of cap 112 as described above.

When cap 112 is fully removed from opening 106, the consumer may remove payload 119 such as by inverting capsule 100. From the above description and the appended drawings, those skilled in the art will appreciate that capsule 100 provides a unique tube and cap configuration that facilitates the sequential positioning of the cap relative to the tube in the sealed position, the venting position, and, finally, the fully removed position. As a result, the payload cavity is controllably vented to equalize any pressure difference between the payload cavity 120 and environment 114. Moreover, the interlocking engagement of cap and tube stops 136 and 164, respectively, as well as hinge 138 and tether 140 facilitate full venting of the payload chamber and provide retention features that reduce the probability of cap 112 undesirably missiling when axially displaced relative to tube 102.

While the above description referencing FIGS. 3–6 discloses an embodiment for venting payload cavity 120 and achieving the other advantages described above, alternative venting configurations may be used with the capsule of the present invention without departing from the scope of the invention as defined by the appended claims. Four such embodiments will now be described with reference to FIGS. 7–15. Following the description of these embodiments, other techniques for minimizing the threat of missiling as well as capsule embodiments that take advantage of any pressure difference between the payload cavity and the environment surrounding capsule 100 will be described.

Figure 7:
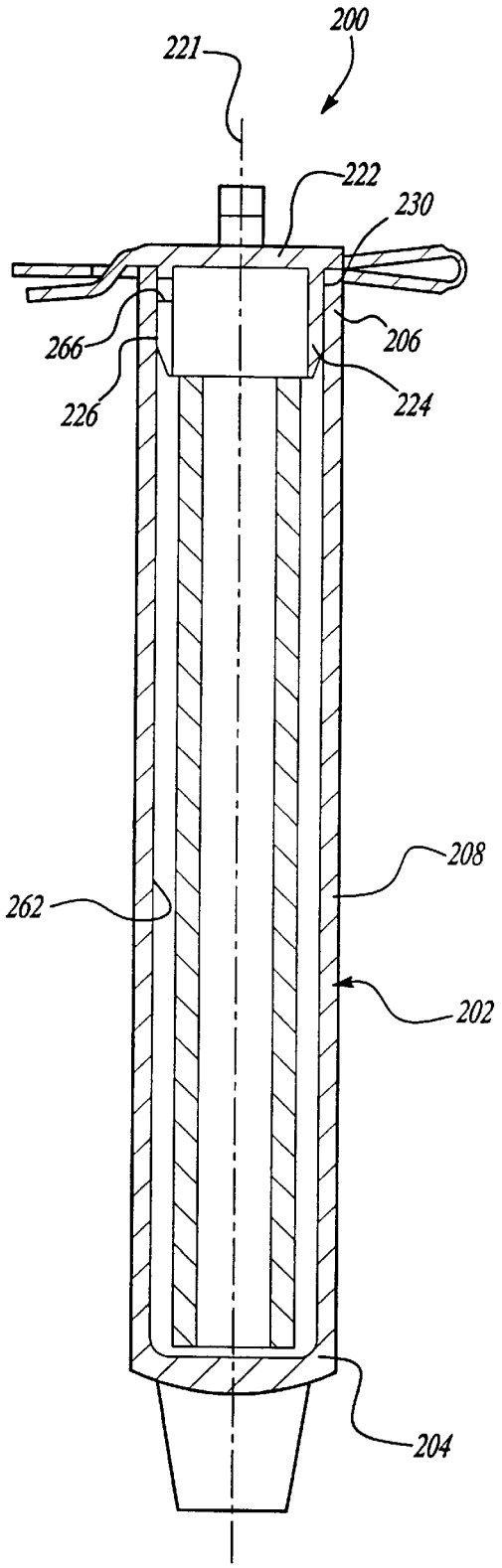
FIG. 7 is an axial cross-sectional view of a delivery capsule according to another embodiment of the present invention.
Figure 8:
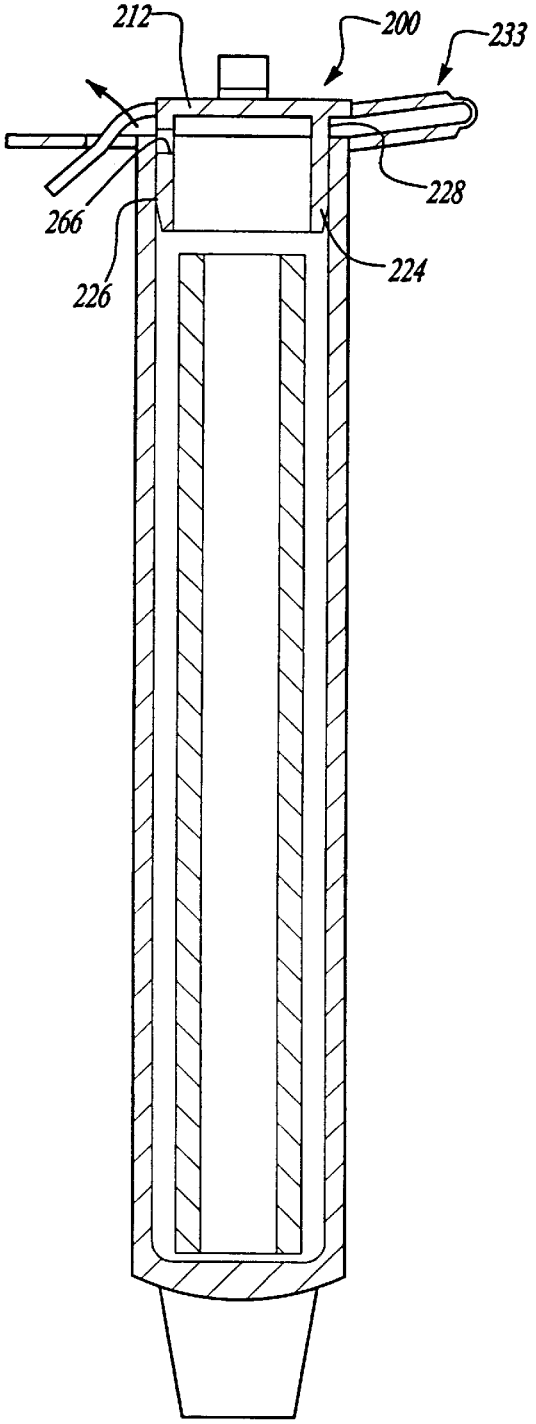
FIG. 8 is a top plan view of the capsule illustrated in FIG. 7 with the cap in a partially open and venting condition.
Figure 9:
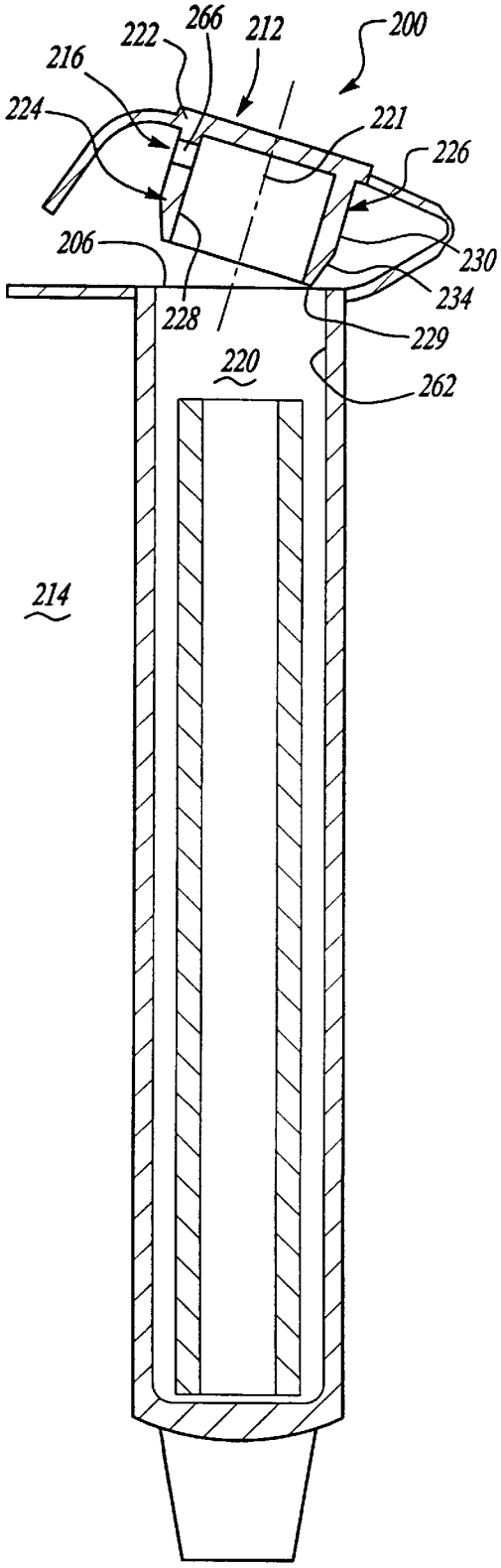
FIG. 9 is a top plan view of the capsule illustrated in FIGS. 7–9 with the cap in its fully open position.

The capsule 200 illustrated in FIGS. 7–9 includes a tube, cap, and venting arrangement similar in function and operation to corresponding components of capsule 100. Accordingly, similar reference numerals are used in FIGS. 7–9 to identify capsule elements that correspond to similar elements in FIGS. 3–6. Capsule 200 is again illustrated in a sealed position (FIG. 7), a venting position (FIG. 8) and, finally, a position where cap 212 is fully removed from tube 202 (FIG. 9).

As shown in FIGS. 7–9, capsule 200 includes a tube 202 defining a closed end 204, an open end 206, and cylindrical side walls 208 that extend from closed end 204 to open end 206 and define a substantially continuous inner surface 262. More particularly, capsule 200 does not include a cap retention apparatus such as that referenced by numeral 118 in FIGS. 3–6. However, it should be appreciated that a cap retention apparatus may be provided with capsule 200 if the retention benefits are desired.

Cap 212 of capsule 200 is again a generally cylindrical tubular member formed about an axis 221 to include an annular top 222 integral with an axially projecting sleeve 224. As best seen in FIG. 9, sleeve 224 defines outer and inner cylindrical surfaces 226 and 228 extending from top 222 to a terminal end face 229. Outer surface 226 includes a seal surface 230 and a taper 234 interconnecting seal surface 230 with end face 229. Those skilled in the art will appreciate that taper 234 facilitates the placement of cap 212 within opening 206. More particularly, when cap 212 is inserted within opening 206, sleeve 224 is displaced radially inwardly toward axis 221 such that when cap 212 is fully inserted in opening 206, as illustrated in FIG. 7, the resiliency of sleeve 224 urges outer sleeve surface 226 against inner tube surface 262 to create a seal therebetween along surface 230. Cap 212 is maintained in the sealed configuration illustrated in FIG. 7 by the frictional forces generated between seal surface 230 and inner tube surface 262. Those skilled in the art will appreciate that the relative sizes of sleeve 224 and inner surface 262 may be modified to effectuate a resilient biasing force sufficient to prevent axial displacement of cap 212 in a variety of operating environments.

After capsule 200 is removed from the container within which it is disposed, e.g., container 12 in FIG. 1, the consumer may access payload cavity 220 by prying cap 212 from opening 206. As cap 212 is axially displaced into the vent position illustrated in FIG. 8, vent opening 266 communicates with the environment 214 outside of capsule 200. As shown, vent opening 266 extends radially through sleeve 224 between inner and outer cylindrical surfaces 226 and 228 thereof. This configuration is distinguishable from the axially extending vent openings in the venting arrangement 116 illustrated in FIGS. 3–6. While a single vent opening 266 is illustrated in FIGS. 7–9 to extend between outer and inner sleeve surfaces 226 and 228, those skilled in the art will appreciate that the size, number and locations of vent openings may be varied to achieve the desired pressure dissipation rate for a particular capsule application.

While the capsule 200 illustrated in FIGS. 7–9 includes a venting arrangement structurally different from that illustrated in FIGS. 3–6 and does not include a cap retention apparatus 118, the tether mechanism 217 of capsule 200 is substantially the same as tether mechanism 117 described above. As a result, tether mechanism 217 provides control over the removal of cap 212 from opening 206 to allow full venting of payload cavity 220 and to prevent missiling of cap 212.

Figure 10:
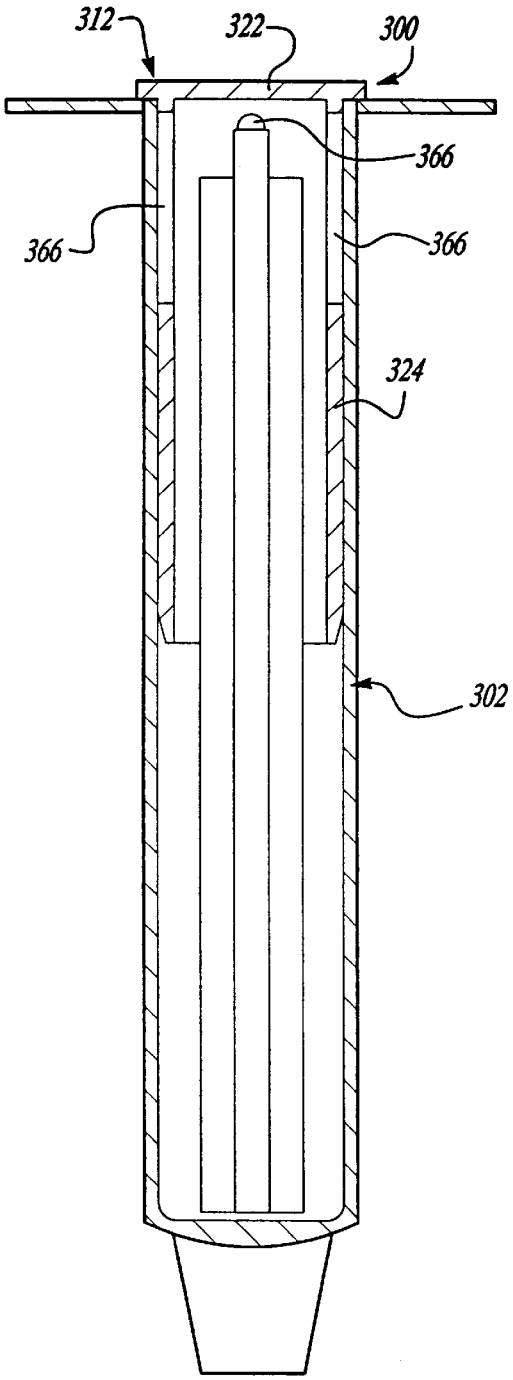
FIG. 10 is an axial cross-sectional view of a payload delivery capsule having a venting mechanism according to another embodiment of the invention.
Figure 11:
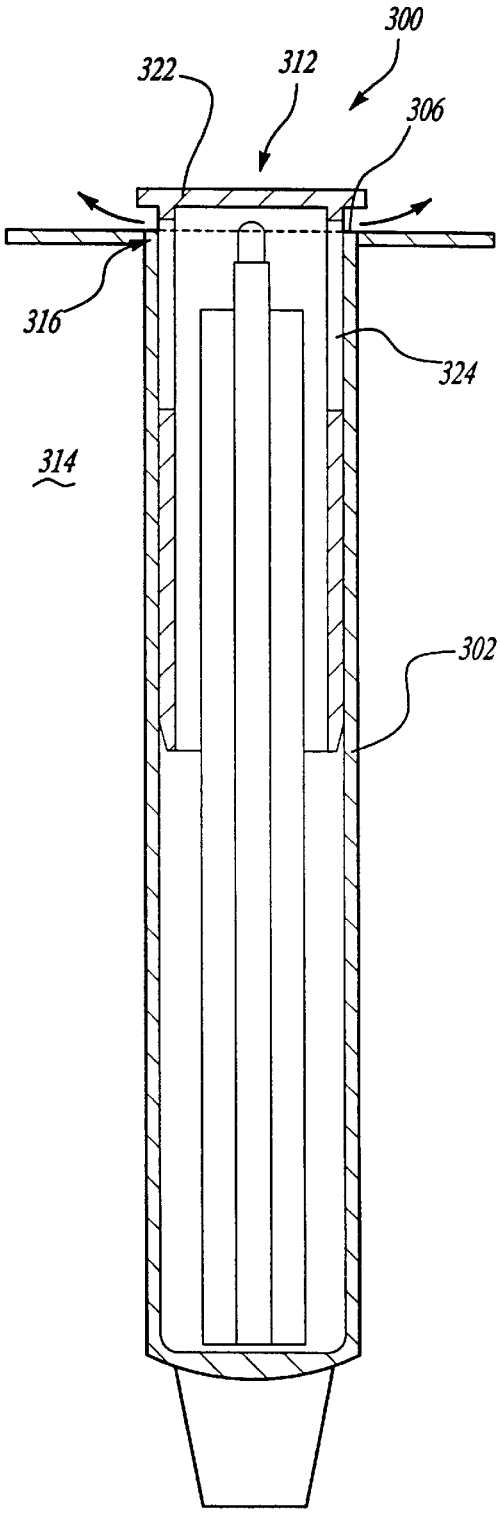
FIG. 11 is an axial cross-sectional view of the payload capsule shown in FIG. 10 with the cap in a partially open and venting position.
Figure 12:
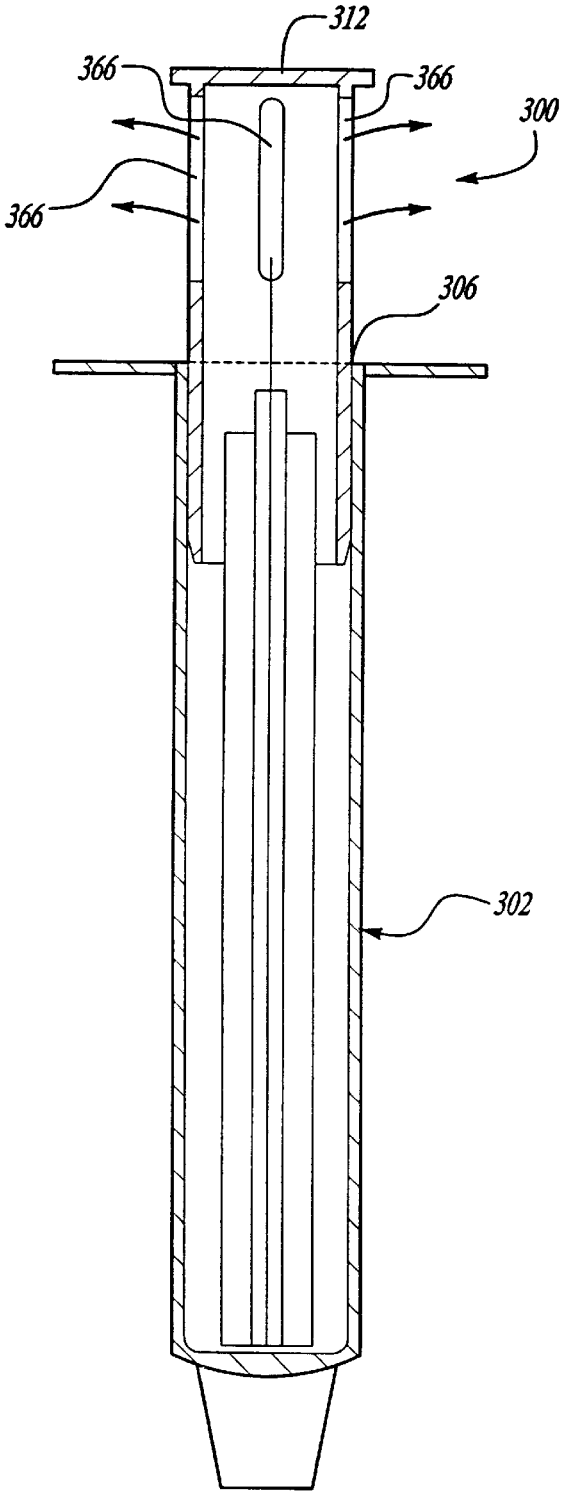
FIG. 12 is an axial cross-sectional view of the capsule illustrated in FIGS. 10 and 11 with the cap in its fully vented position.

Still another venting arrangement 316 is illustrated in FIGS. 10–12. More particularly, a capsule 300 is illustrated to include a tube 302 substantially similar in configuration to tube 202 illustrated and described above. Capsule 300 further includes a cap 312 again having an annular top 322 integral with an axially projecting sleeve 324. Sleeve 324 of cap 312 is similar in configuration to cap 212 illustrated in FIGS. 7–9. However, sleeve 324 is elongated and includes a plurality of elongated vent openings 366. The elongation of sleeve 324 increases the forces resisting removal of cap 312 from opening 306 while the increased number and size of vent opening 366 assist in more rapidly dissipating any pressure difference between payload cavity 320 and the environment 314 surrounding capsule 300.

Those skilled in the art will again appreciate that capsule 300 may be provided with a hinge or tether such as those illustrated and described above for preventing missiling of cap 312.

During removal of cap 312 from tube opening 306, cap 312 is axially displaced relative to tube 302 from the sealed position illustrated in FIG. 10, to the partially venting position illustrated in FIG. 11, to the fully vented position illustrated in FIG. 12, and, finally, to a position where cap 312 is fully removed from opening 306 (not shown).

The above-described embodiments of the present invention each include a cap that is axially displaced by the consumer to gain access to the payload cavity. Those skilled in the art will further appreciate that the capsule cap may be removably coupled to the tube via threaded engagement therewith or other means requiring rotational as well as axial displacement of the cap relative to the tube to gain access to the payload cavity. Such an embodiment of the present invention is illustrated in FIGS. 13 and 14.

Figure 13:
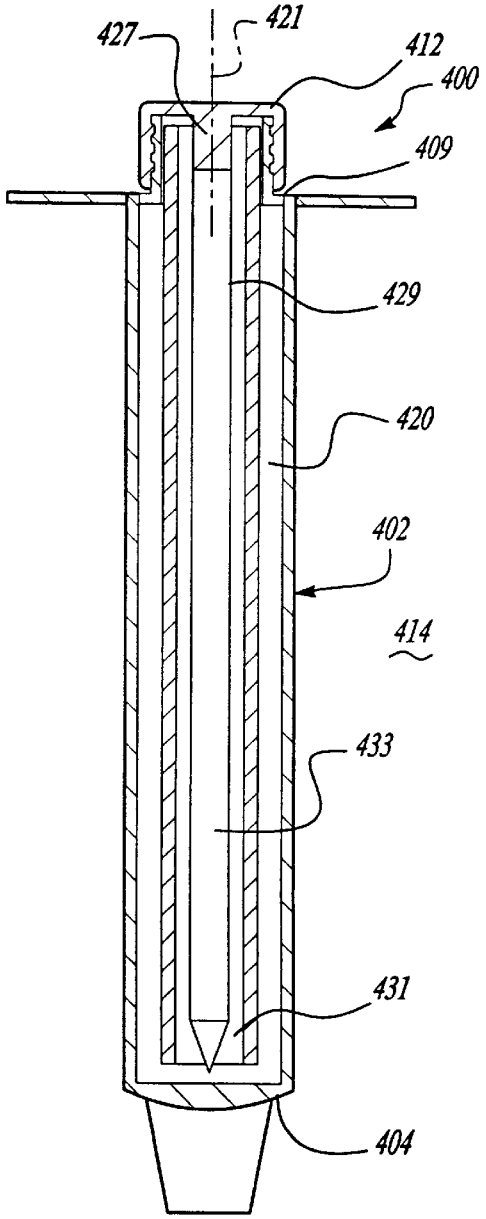
FIG. 13 is an axial cross-sectional view of a capsule having a threaded cap and sealed mandrel.
Figure 14:
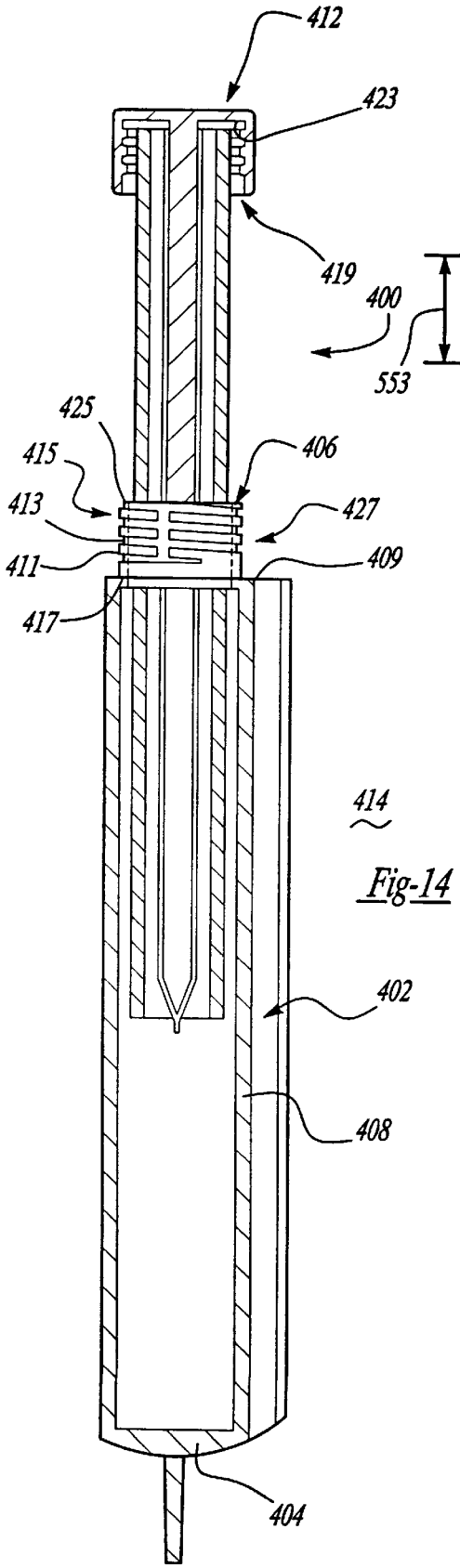
FIG. 14 is an axial cross-sectional view of the capsule illustrated in FIG. 13 with the cap and mandrel partially removed from the payload cavity.

A capsule 400 is illustrated in FIGS. 13 and 14 to include a tube 402 defining a dosed end 404 and an open end 406 (FIG. 14). As illustrated, open end 406 is defined by an externally threaded cylindrical projection 407 extending axially from an upper end 409 of tube 402. Threads 415 include angled protrusions 411 that extend from a recessed surface 413 of projection 407. The angled protrusions 411 of threads 415 are interrupted by an axially extending recess 417 that defines a vent 466.

In the sealed position illustrated in FIG. 13, a seal surface 423 defined by cap 412 engages an upper end seal face 425 of projection 407 to isolate payload cavity 420 from the environment 414 surrounding capsule 400. Those skilled in the art will appreciate that vent 417 facilitates the dissipation of pressure from payload cavity 420 upon counter-clockwise rotation of cap 412 relative to tube 402.

The capsule 400 of FIGS. 13 and 14 also includes a mandrel 429 that reduces the volume of cavity 420 and therefore the forces generated by pressurized gas within cavity 420.

With reference to FIG. 13, cap 412 includes a cylindrical hub 427 extending axially along axis 421. Mandrel 429 is coupled to hub 427 such as by heat sealing or other method generally recognized in the art. Mandrel 429 also includes an end 431 remote from cap 412 that is heat sealed or otherwise closed so that the mandrel cavity 433 is isolated from payload cavity 420. By isolating cavity 433 from cavity 420, the effective volume of cavity 420 is reduced and any pressure difference between cavity 420 and environment 417 is dissipated more rapidly when cavity 420 is vented such as via vent 417. Additionally, as the surface area of cap 412 upon which the pressure within cavity 420 acts is decreased by the cross-sectional area of hub 427, the axial force urging cap 412 away from tube 402 is also decreased thereby minimizing concerns over cap missiling. Those skilled in the art will appreciate that while the sealed mandrel is illustrated and described only with reference to FIGS. 13 and 14, the mandrel may be incorporated in the capsule configurations described above.

Figure 15:
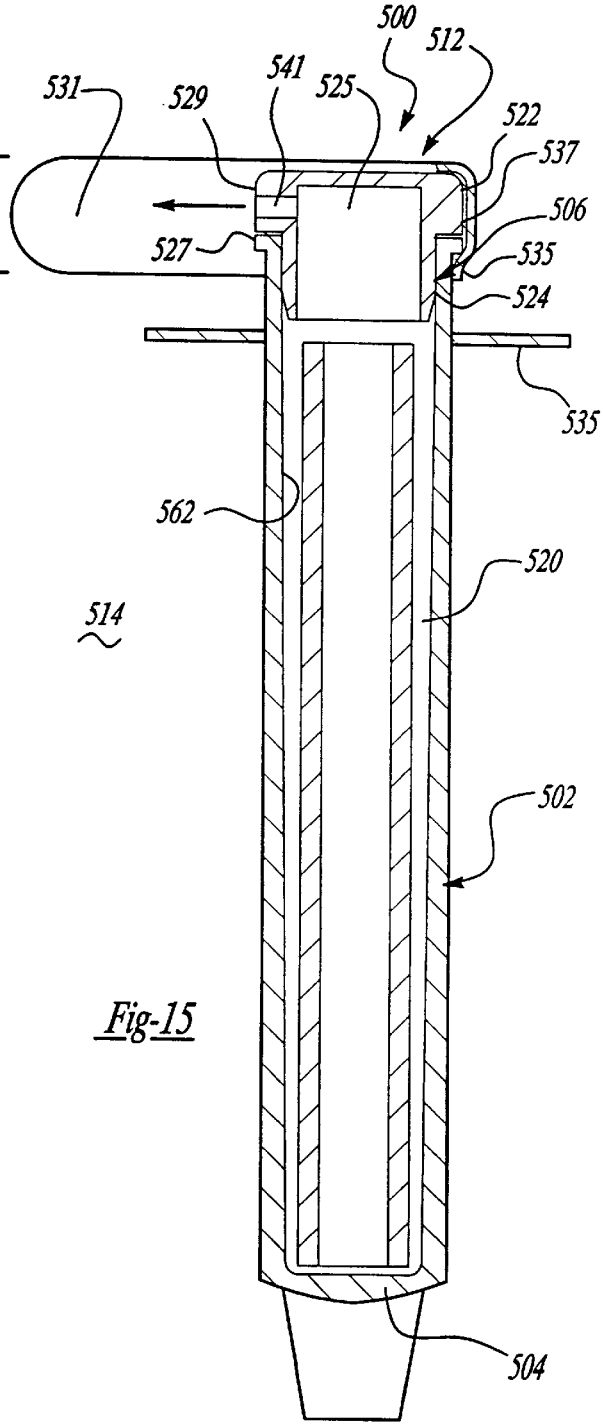
FIG. 15 is an axial cross-sectional view of a vented cap sealed by an adhesive tape seal.

Turning now to FIG. 15, another vent configuration is illustrated for a capsule 500 having a cap 512. The embodiment illustrated in FIG. 15 is most clearly distinguishable from the cap and vent configurations illustrated in FIGS. 3–12 based upon the positioning of radial vent opening 541. More particularly, cap 512 includes a head portion 522 integral with axially extending sleeve portion 524. Head 522 and sleeve 524 are each generally cylindrical and define a cavity 525 that communicates with payload cavity 520 when cap 512 is in the sealed position illustrated in FIG. 17. Radial vent opening 541 extends from cavity 525 to an exterior surface 527 of head 522.

The outer edge 529 of vent opening 541 does not sealably engage the inner surface 562 of tube 502 as in the capsule embodiment illustrated in FIGS. 7–9. Rather, capsule 500 is provided with a seal tape 531 that is removably connectable to cap 512 to cover radial vent opening 541 thereby preventing airflow therethrough. When seal tape 531 is removed from cap 512, pressurized gas within cavity 520 is expelled through radial vent opening 541 and into environment 514.

Seal tape 531 includes an adhesive on a first side 537 thereof and is preferably of a sufficient width 533 so as to extend axially downward from vent opening 506 to engage tube 502 as is indicated by reference numeral 535. The extension of seal tape 531 in this manner further prevents missiling of cap 512.

Those skilled in the art will appreciate that a variety of material is generally available for use as seal tape 531. The selection of the specific type of material for seal tape 531 will depend upon the specific environment in which capsule 500 is to be used. Accordingly, a variety of sealing materials generally known in the art may be used to meet the operational requirements of capsule 500 without departing from the scope of the invention as defined by the appended claims.

Figure 16:
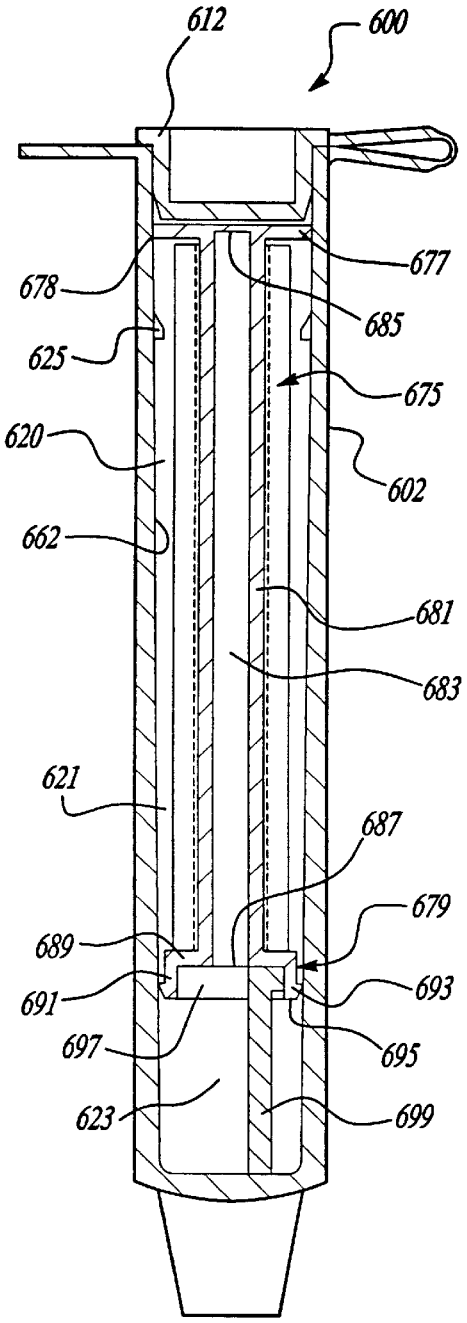
FIG. 16 is an axial cross-sectional view of a payload delivery capsule defining upper and lower pressure chambers within the payload chamber.
Figure 17:
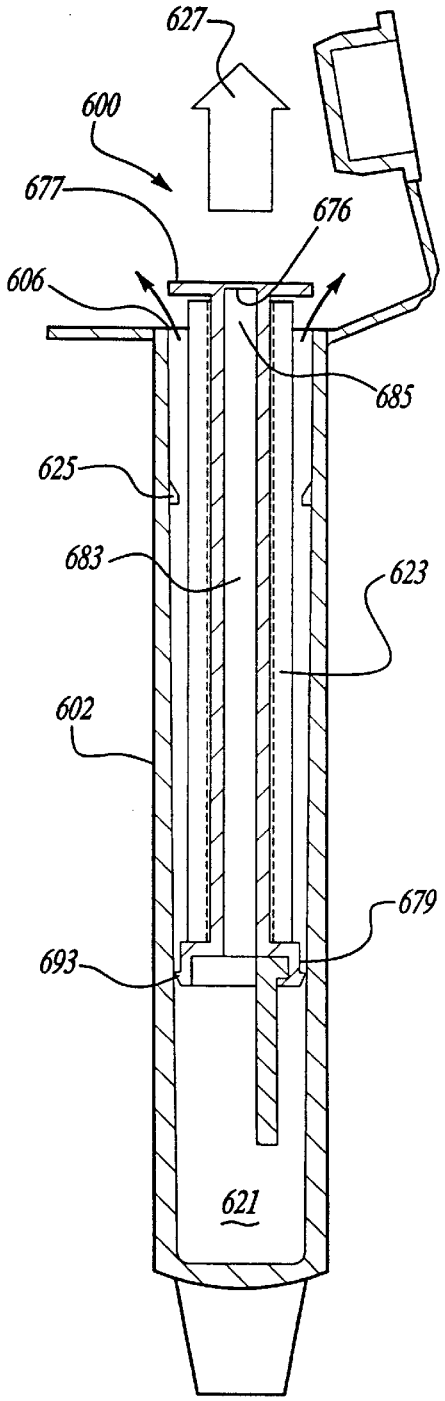
FIG. 17 is an axial cross-sectional view of the capsule illustrated in FIG. 16 with the payload stand partially ejected from the capsule payload chamber.
Figure 18:
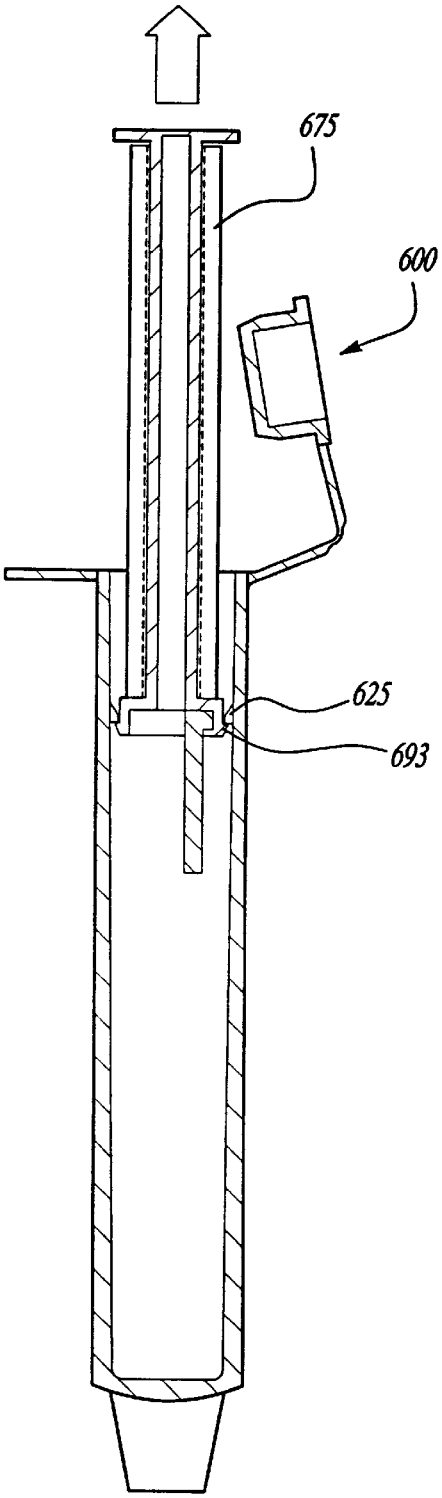
FIG. 18 is an axial cross-sectional view of the capsule illustrated in FIGS. 16 and 17 with the payload stand in a fully ejected position.

An embodiment of the payload delivery capsule 600 that beneficially uses the pressure increase from gas permeation into the payload cavity to present the payload from the tube will now be described with reference to FIGS. 16–18. In FIG. 16, a cap 612 is shown in a sealed position relative to a tube 602 similar in configuration to the above-described capsule tubes. It should again be appreciated that while cap 612 is not illustrated to include any of the above-described venting arrangements, cap retaining apparatuses, or tether, these features may be included with the capsule 600.

Tube 602 again defines an inner surface 662 defining a payload cavity 620. A payload carrier 675 is slidably disposed within cavity 620 and includes an upper platform 677 and a lower platform 679 interconnected by a cylindrical mandrel 681. Mandrel 681 is a hollow cylindrical member defining a mandrel chamber 683 having a closed end 685 at upper platform 677 and an open end 687 at lower platform 679. More particularly, lower platform 679 includes a cylindrical platform member 689 that extends radially from mandrel 681 and is integral with a cylindrical sleeve 691 extending axially away from mandrel 681. Sleeve 691 includes a seal ring 693 on the outer surface thereof for sealing engagement with inner surface 662 of tube 602. Lower platform 679 also includes a terminal surface 695 from which a cylindrical recess 697 extends axially toward lower platform member 689 and communicates with mandrel chamber 683. A foot 699 extends from lower platform 679 to engage closed end 604 of tube 602 and position mandrel 681 in a predetermined location within tube 602. Those skilled in the art will appreciate that the cooperative and sealing engagement between seal ring 693 and inner surface 662 of tube 602 separates payload cavity 620 into an upper chamber 621 and a lower chamber 623. Finally, tube 602 includes an annular stop ring 625 that extends from inner surface 662 into cavity 620 to limit the axial movement of mandrel 681 as hereinafter described.

The operation of capsule 600 will now be described with reference to its sealed position illustrated in FIG. 16, the partially deployed position illustrated in FIG. 17, and the payload presenting position illustrated in FIG. 18. Initially, when capsule 600 in its sealed position shown in FIG. 16 and is disposed within container 12 for a sufficient period of time, gaseous exchange occurs from the liquid within the container into cavity 620. As a result, upper and lower chambers 621 and 623 of cavity 620 reach an equilibrium pressure with the liquid within container 12. When capsule 600 is removed from pressurized container, the pressure within upper and lower chambers 621 and 623 is generally greater than the environment 614 surrounding capsule 600.

After capsule 600 is removed from its container, cap 612 may be axially displaced from its sealed position illustrated in FIG. 16 in a substantially similar manner to that described above with reference to the other embodiments of the invention. When cap 612 is displaced from its sealed position illustrated in FIG. 16 to the open position illustrated in FIG. 17, the pressure within upper chamber 621 is dissipated to the environment 614 initially through the gap 678 between upper platform 677 and inner surface 662 (FIG. 16) and, eventually, directly from opening 606 when upper platform 677 is extended beyond opening 606 (FIG. 17). Those skilled in the art will appreciate that cap 612 may include one of the venting arrangements described above and illustrated in the appended drawings without departing from the scope of the invention as defined by the appended claims.

Returning to the structure and operation of mandrel 681 within cavity 620, dissipation of pressure from upper chamber 621 creates a pressure difference between the upper and lower chambers. This pressure difference acts upon lower platform 679 as well as a portion 676 of upper platform 677 communicating with closed end 685 of mandrel chamber 683 to create a corresponding force urging the mandrel axially upward as indicated by arrow 627 in FIG. 17. During movement of mandrel 681, seal ring 693 continues to isolate the upper and lower cavity chambers while also limiting the removal speed of mandrel 681. Moreover, as carrier 675 rises within tube 602, the volume of lower chamber 623 increases thereby causing a decrease in the pressure therewithin. The decreasing pressure within lower chamber 623 also limits the removal speed of carrier 675. In some circumstances, during the removal of carrier 675, the pressure in upper chamber 621 may reach a level greater than the pressure in lower chamber 623 due to the sealing effect of seal ring 693. Further removal of carrier 675 may be effectuated by the consumer urging the carrier in an upward direction. Alternatively, the relative sizes of upper chamber 621 and lower chamber 623 can be established such that the pressure within lower chamber 623 is sufficient to urge carrier 675 to the payload presentation position illustrated in FIG. 18. In this position, seal ring 693 abuts annular stop ring 625 to prevent further axial movement of carrier 675.

By allowing a gaseous exchange between the fluid surrounding capsule 600 while the capsule is submerged within container 12, the present invention presents the payload contained within cavity 620 to the consumer in an efficient manner. While a specific embodiment of the payload carrier 675 providing this benefit has been described and illustrated in the appended drawings, those skilled in the art will appreciate that numerous modifications within the general knowledge of those skilled in the art can be made without departing from the scope of the invention as defined by the appended claims.

Additionally, the present invention contemplates various other beneficial uses of the heightened pressure within the capsule payload cavity. For example, as is described below with reference to FIGS. 19–23, the capsule according to the present invention may be provided with a one-way reed relief valve as part of the venting arrangement so as to produce an audible sound, tone, or a musical note upon the displacement of the capsule cap relative to the tube. This sound may be varied to indicate a particular tonal message associated with a particular payload or used simply to provide a more pleasing payload presentation.

Figure 19:
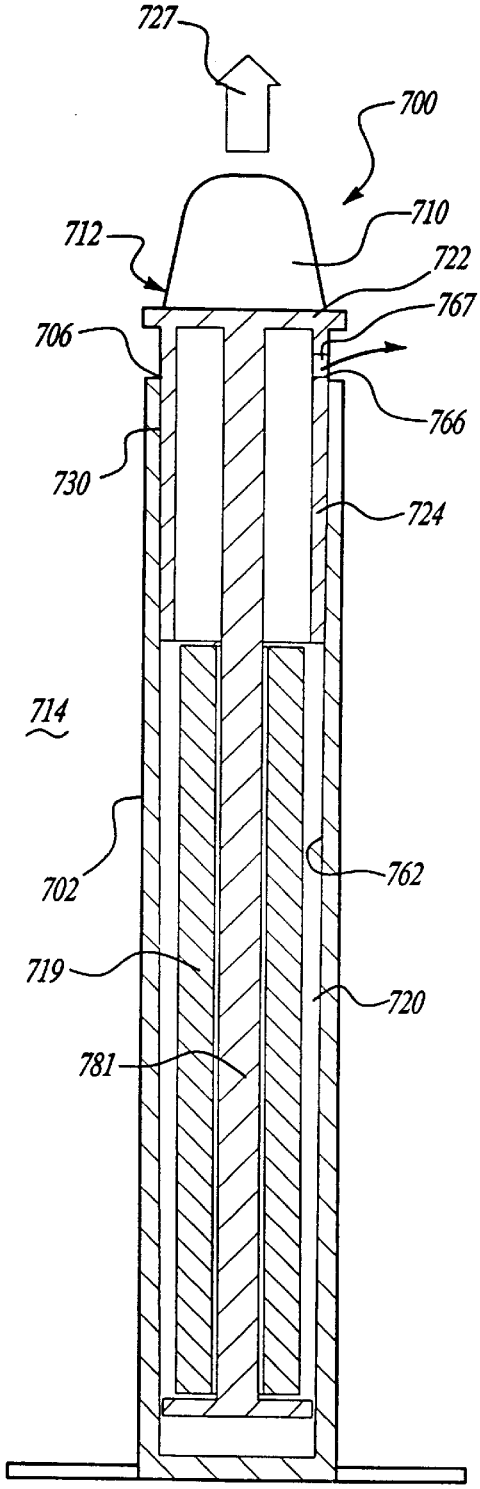
FIG. 19 is an axial cross-sectional view of another embodiment of a payload delivery capsule wherein the venting arrangement generates an audible sound tone, musical note, or plurality of musical notes during venting.
Figure 20:
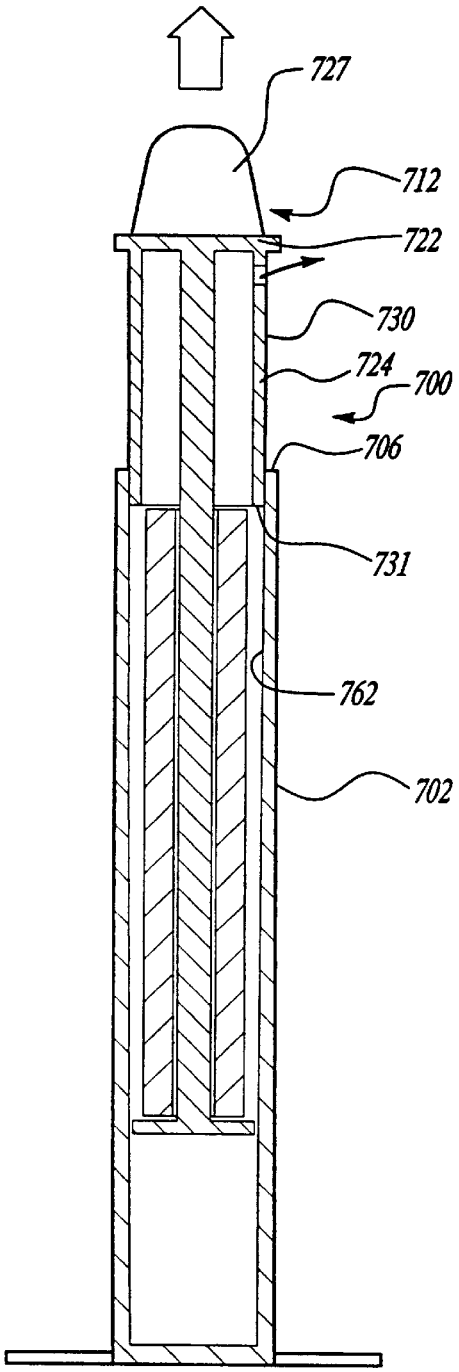
FIG. 20 is an axial cross-sectional view of the payload delivery capsule of FIG. 19 with the cap in an extended position.

One embodiment of a capsule having a sound producing relief valve is illustrated in FIGS. 19 and 20. In this embodiment, capsule 700 indudes a cap 712 at the open end 706 of tube 702. Cap 712 includes a tab 710 extending axially upwardly from annular top 722. As with the above-described embodiments, capsule 700 is intended to be oriented within container 12 (FIG. 1) with the tab 710 in an upright position proximate to orifice 32 (FIG. 2*b*). As a result, in the capsule embodiments illustrated in FIGS, 3–18 where the tab is disposed on the closed end of the capsule opposite the cap, the capsule is oriented within the container with the cap down as illustrated in FIGS. 2*a* and 2*b*. Conversely, the embodiment illustrated in FIGS. 19 and 20 includes the tab integral with the cap such that the tab and cap are oriented in an upright position proximate to orifice 32 (FIG. 2*b*) when capsule 700 is placed in the container. By this arrangement, tab 710 and cap 712 are urged above the liquid fill line 24 (FIG. 2*b*) soon after the opening of container 12. Accordingly, when the pressure contained in container head 28 is dissipated through orifice 32, the heightened pressure within payload cavity 720 urges cap 712 upwardly in the direction indicated by arrow 727. Simultaneously, the buoyancy of capsule 700 urges the capsule toward the presentation position illustrated in FIG. 2*b*. Accordingly, the capsule is presented to the consumer through orifice 32 while cap 712 is axially urged from opening 706.

Cap 712 includes an axial sleeve 724 extending from top 722 for frictional engagement with the inner surface 762 of tube 702. It will be appreciated that while the pressure within payload cavity 720 tends to displace cap 712, mandrel 781, and payload 719 axially upward from tube 702, the frictional forces between the outer surface 730 of sleeve 724 and the inner surface 762 of tube 702 tends to resist this movement.

Sleeve 724 further includes a vent opening 766 extending radially from sleeve 724. In the illustrated embodiment, a one-way reed relief valve 767 conventional in the art is disposed within vent opening such that air passing therethrough creates a desired audible sound, tone, or musical note. Those skilled in the art will appreciate that a variety of one-way reed relief valves and equivalent tonal generating mechanisms may be used with capsule 700.

The movement of capsule 700 through orifice 32 (FIG. 2*b*) and the axial displacement of cap 712 to expose reed relief valve 767, allows the sound, tone, or musical note to be heard by the consumer as the capsule 700 is being presented. This tonal presentation of the capsule may simply be used to create a more pleasing presentation or, in the alterative, a plurality of one-way reed relief valves may be provided in sleeve 724 to produce a harmonic sound. The sound, tone, or note produced could be varied based upon the payload within capsule 700 whereupon the consumer will come to associate a particular prize or payload with a particular note or tone.

As illustrated in FIGS. 19 and 20, sleeve 724 is elongated to maintain the seal between outer surface 730 thereof and the inner surface 762 of tube 702 to maintain the audible tone over an extended period. More particularly, the tone will be maintained until the distal end 731 of sleeve 724 is urged beyond opening 706.

Figure 21:
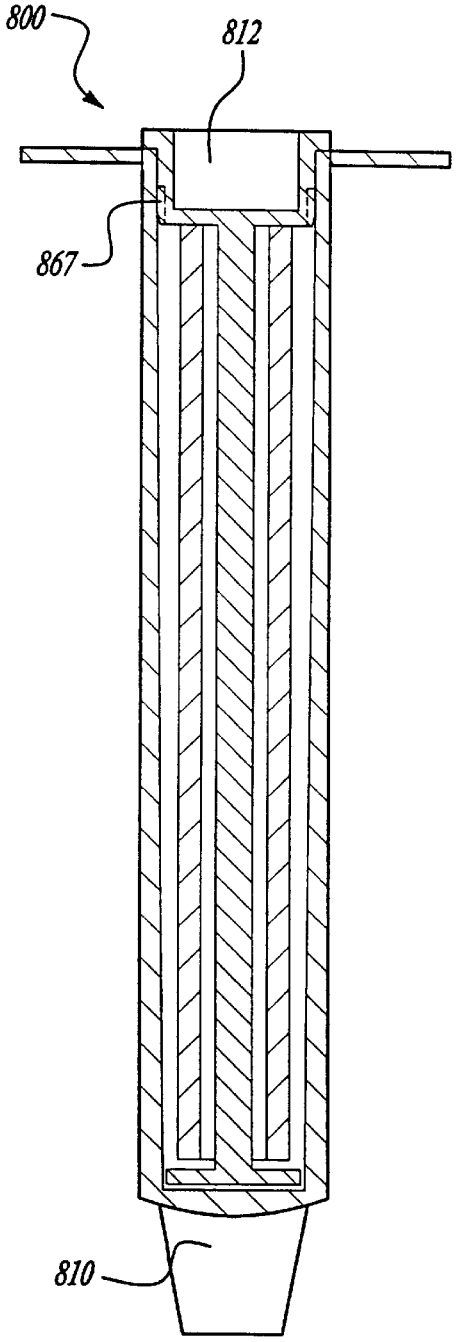
FIG. 21 is an axial cross-sectional view of a payload delivery capsule with an ejection damping stand and tone or musical note generating vents in a sealed position.
Figure 23:
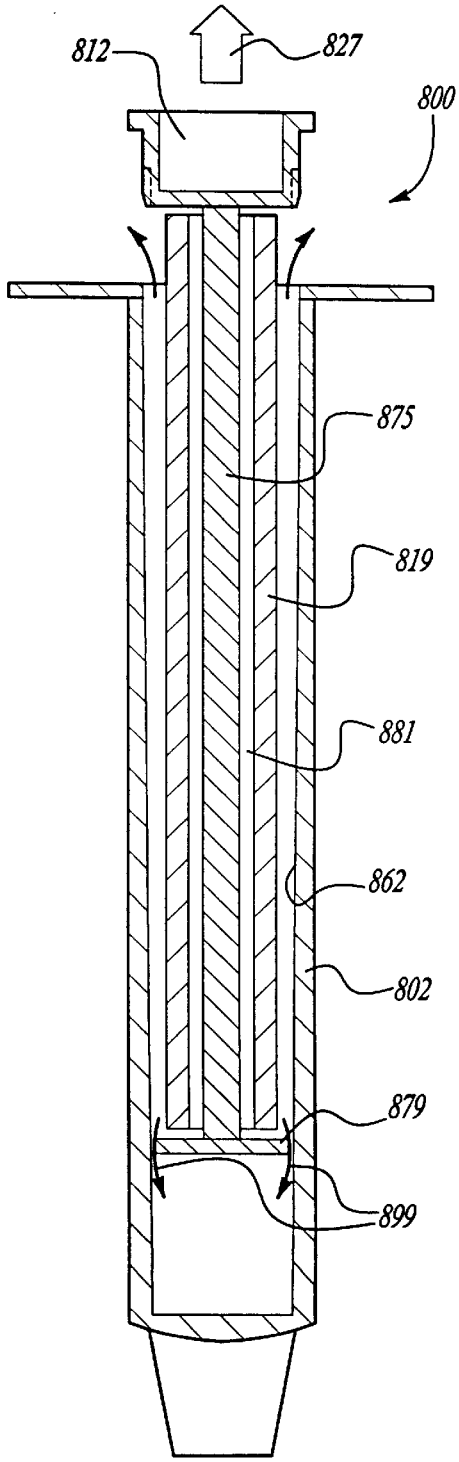
FIG. 23 is an axial cross-sectional view of the capsule illustrated in FIGS. 21 and 22 with the cap fully removed.

FIGS. 21 and 23 illustrate a capsule 800 wherein the tone generating valves 867 are provided within a cap 812 positioned opposite the retraction tab 810 in a manner consistent with the embodiments illustrated in FIGS. 3–18. By locating tone generating valves 867 opposite retraction tab 810, the tone resulting from pressure dissipation is not generated until after capsule 800 is removed from the container 12.

Figure 22:
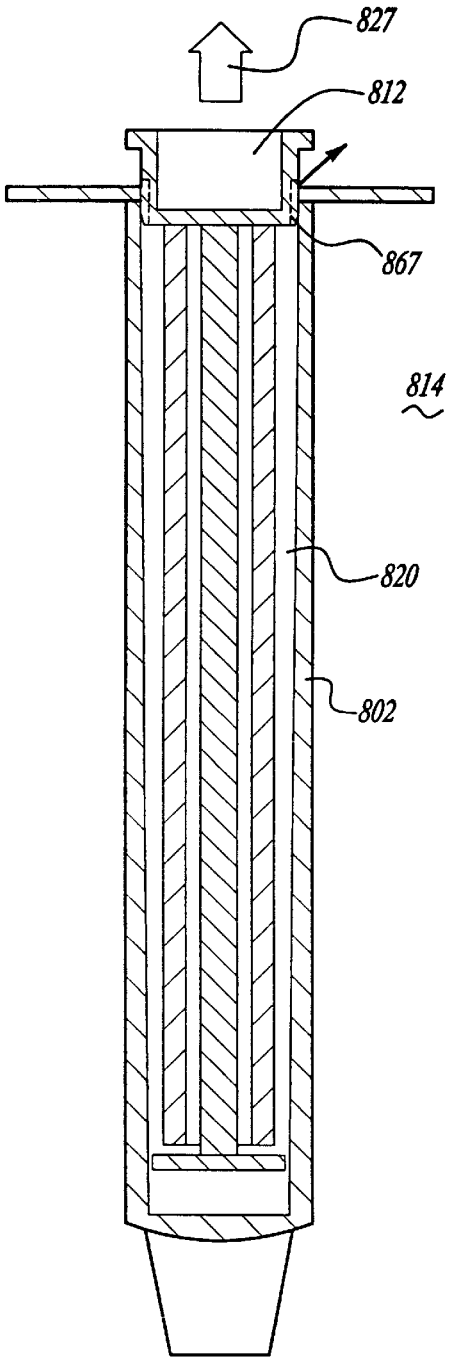
FIG. 22 is an axial cross-sectional view of the capsule illustrated in FIG. 21 with the cap in a partially venting configuration.

More particularly, capsule 800 is configured to generate the tone when valves 867 communicate with both the cavity 820 and the environment 814 surrounding tube 802 as illustrated in FIG. 22. In this venting position, the pressure within cavity 820 is expelled through the valves 867 to generate the tone. The cap 812 and the accompanying payload 819 is extracted from tube 802 by manually displacing the cap 812 and carrier 875 in the direction indicated by arrow 827.

Carrier 875 includes a mandrel 881 having a lower platform 879 that frictionally engages the inner surface 862 of tube 802 to restrict axial movement of cap 812 and carrier 875. The frictional engagement generates motion restricting forces indicated by arrows 899 to minimize the potential for missiling of the cap and carrier. It should be appreciated that capsule 800, as with the other embodiments of the present invention, may be provided with stops such as those described with reference to FIGS. 16–18 and referenced by numeral 625 to prevent release of carrier 875 from capsule 800.

Figure 24:
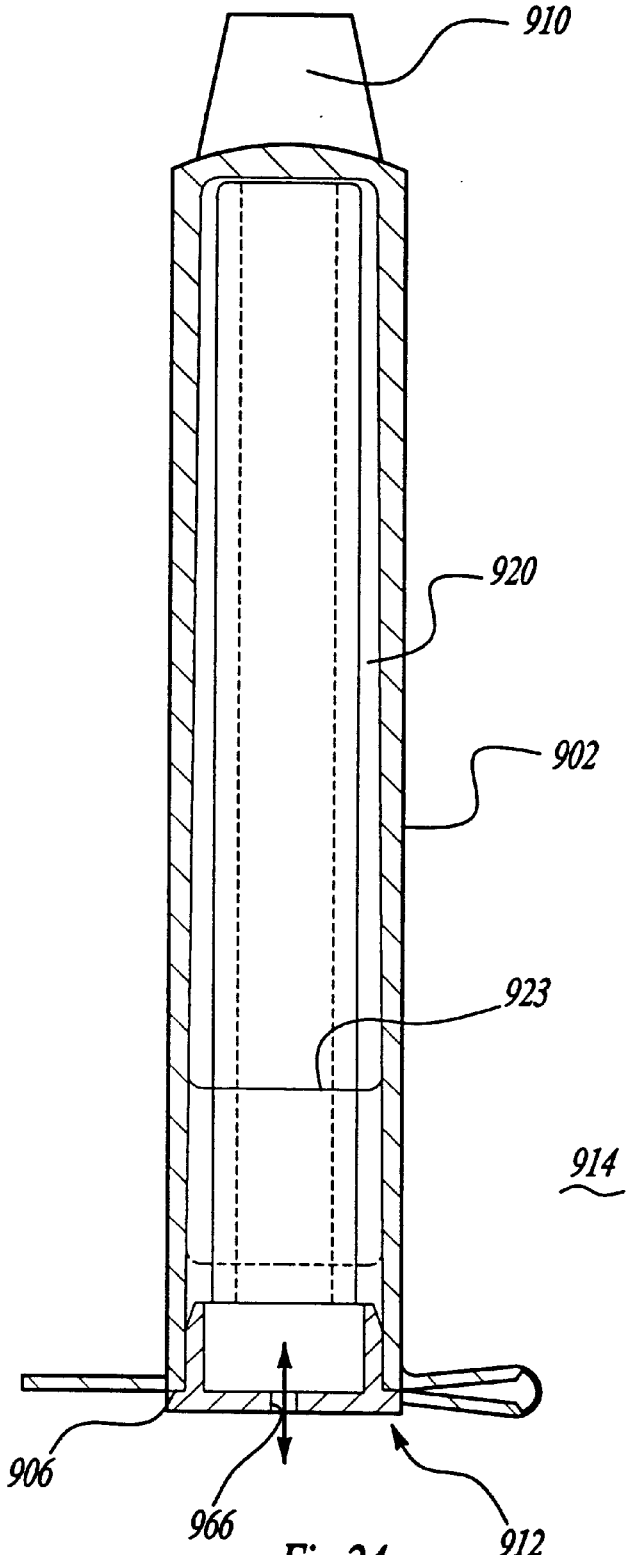
FIG. 24 is an axial cross-sectional view of an alternative venting arrangement for a payload delivery capsule.

Still another embodiment of the present invention is illustrated in FIG. 24. In this embodiment, cap 912 is coupled to the open end 906 of tube 902 opposite retraction tab 910. Cap 912 includes an opening 966 centered on cap 912 and hydraulically connected to cavity 920 via recess 925 and to the environment 914 surrounding capsule 900. Accordingly, when capsule 900 is disposed within a liquid filled container 12, such as that illustrated in FIG. 2*a,* liquid fluid enters cavity 920 through opening 966. When capsule 900 is immersed within the liquid fluid for a sufficient period of time, gas permeates through walls 908 and liquid fluid enters through opening 966 until cavity 920 reaches a liquid fluid/gas equilibrium at which time the liquid fluid within the cavity seeks an equilibrium level such as that indicated by reference numeral 923 in FIG. 24. Upon the opening of the container 12, the pressure contained in head 28 (FIG. 2*b*) is expelled through the container orifice 32 leaving the capsule cavity 920 at an elevated pressure relative to the surrounding liquid fluid. As a result, the pressurized liquid fluid and gas within cavity 920 is expelled through opening 966 thereby creating a jet that axially propels the capsule upwardly from container 12 to its presentation position illustrated in FIG. 2*b*.

It should be appreciated that the payload 919 contained within cavity 920 is waterproof in nature or contained within a waterproof housing such as a plastic bag. Cavity 920 is preferably flushed with nitrogen or carbon dioxide prior to insertion within container 12 so as to be inert chemically to the contents of both the capsule and/or the product, or to minimize the liquid fluid in the capsule.

The above description includes a discussion of numerous capsule embodiments that allow a gaseous exchange between a liquid and capsule cavity to achieve benefits either to the capsule or the liquid. More particularly, the benefits provided to the capsule include payload presentation opportunities available through the use of a pressurized gas within the cavity and devices for managing the dissipation of the pressure when the capsule is opened to make the opening event more enjoyable. The transfer of gaseous material from the capsule to the liquid may be provided in order to provide benefits to the liquid.

Various other advantages and modifications will become apparent to one skilled in the art after having the benefit of studying the teachings of the specification, the drawings and the following claims.

What is claimed is:

1. A capsule comprising:

a body defining a sealed cavity;

a payload disposed in said sealed cavity;

a cap movable between a sealed position wherein said cap engages said body to seal said cavity and an open position providing access to said cavity; and presentation means for moving said payload toward said cap when said cap is in said open position, said presentation means including a payload carrier disposed in said cavity, said payload carrier including a diaphragm separating said cavity into a first chamber and a second chamber.

2. The capsule of claim 1 wherein said payload carrier includes an upper platform, a lower platform having said diaphragm, and a mandrel interconnecting said upper platform and said lower platform.

3. The capsule of claim 2 wherein said lower platform includes a foot, said mandrel extending axially along an axis, said foot extending axially from said lower platform.

4. The capsule of claim 1 wherein said body includes an inner surface defining said cavity and a first stop extending into said cavity from said inner surface and wherein said carrier includes a second stop engageable with said first stop to limit movement of said carrier relative to said body.

5. A capsule comprising:

a body defining a cavity and an opening communicating with said cavity;

a payload disposed in said cavity;

sealing means for sealing said cavity, said cavity being capable of holding a gas at a first pressure greater than atmospheric pressure when said cavity is sealed;

a cap movable between a sealed position wherein said cap engages said body to seal said cavity and a vent position wherein said capsule includes a passage communicating pressurized gas from said cavity;

vent means for selectively venting said pressurized gas from said cavity; wherein said capsule body is a tube, said tube having an inner surface, an outer surface, a closed end, and an open end defining said opening; and said cap includes a cap vent recess, said tube includes a tube vent recess cooperative with said cap vent recess to define said passage when said cap is in said vent position;

said cap includes an axial sleeve defining a radial opening extending therethrough and communicating with said cavity when said cap is in said sealed and vent positions, said radial opening sealed by said tube when said cap is in said sealed position, said radial opening allowing pressurized gas to pass from said cavity when said cap is in said vent position.

6. A capsule comprising:

a body defining a cavity and an opening communicating with said cavity;

a payload disposed in said cavity;

sealing means for sealing said cavity, said cavity being capable of holding a gas at a first pressure greater than atmospheric pressure when said cavity is sealed;

a cap movable between a sealed position wherein said cap engages said body to seal said cavity and a vent position wherein said capsule includes a passage communicating pressurized gas from said cavity; and vent means for selectively venting said pressurized gas from said cavity; wherein said vent means includes audible sound generating means for generating an audible sound when said venting means vents said pressurized gas from said cavity, said audible sound generating means being a reed valve coupled to said cap to define a vent opening.

7. The capsule of claim 6 further comprising connecting means for coupling said cap to said body when said cap is removed from said opening.

8. The capsule of claim 7 wherein said connecting means includes a hinge integral with said cap and said body.

9. The capsule of claim 8 wherein said connecting means includes a tether coupling said cap and said body.

10. The capsule of claim 9 wherein said tether removably couples said cap to said body.

* * * * *